United States Patent [19]

Kawamata et al.

[11] Patent Number: 4,770,119

[45] Date of Patent: Sep. 13, 1988

[54] SUPPORT DEVICE FOR PLATING AN ITEM HAVING FINE PARTS

[75] Inventors: Yuuji Kawamata; Tomohiko Iino, both of Souka; Ryoichi Suzuki, Sumida; Noriyuki Haga, Saitama, all of Japan

[73] Assignee: Senju Metal Industry Co., Ltd., Tokyo, Japan

[21] Appl. No.: 15,257

[22] Filed: Feb. 17, 1987

Related U.S. Application Data

[62] Division of Ser. No. 845,226, Mar. 27, 1986, Pat. No. 4,695,481.

[30] Foreign Application Priority Data

Mar. 28, 1985 [JP] Japan ..... 60-061815

[51] Int. Cl.[4] ..... B05C 13/02

[52] U.S. Cl. ..... 118/503; 118/74; 118/425

[58] Field of Search ..... 118/425, 500, 503, 74

[56] References Cited

U.S. PATENT DOCUMENTS 3,543,668 12/1970 Vlock ..... 118/500 X 3,756,852 9/1973 Scheetz et al. ..... 118/425 X

*Primary Examiner*—John P. McIntosh

*Attorney, Agent, or Firm*—Sughrue, Mion, Zinn, Macpeak & Seas

[57] ABSTRACT

A method and device of performing plating of an item having a row of fine parts, e.g. a flatpack IC are disclosed. The method comprises immersing said item in a bath of molten solder, removing said item from said bath while maintaining said item in an attitude such that said row of fine parts is sloped with respect to the surface of said molten solder, and causing flux to exert a fluxing action on said molten solder which adheres to said fine parts, thereby decreasing the surface tension of the solder adhering to said fine parts and preventing bridges of solder from forming between said fine parts.

4 Claims, 2 Drawing Sheets

SUPPORT DEVICE FOR PLATING AN ITEM HAVING FINE PARTS

This is a division of application Ser. No. 06/845,226 filed Mar. 27, 1986 now issued as U.S. Pat. No. 4,695,481, issued Sept. 22, 1987.

BACKGROUND OF THE INVENTION

The present invention relates to a method of performing plating of an item having fine parts in rows, and more particularly, but not exclusively, it relates to a method of performing preliminary plating of leads coming out of a flatpack integrated circuit and a support device in the form of a clip for use in such preliminary plating.

A flatpack integrated circuit is a square or rectangular encapsulated integrated-circuit package with leads coming out from two or four sides of the package, in the same plane as the package.

Flatpack IC's are generally interconnected on a printed circuit board by the following procedures: solder cream is applied to selected portions of the circuit board and after placing a flatpack IC on the board, the solder coat is melted either in a reflow furnace or by laser light, thereby soldering the IC to the circuit board. However, with this process, the IC may sometimes be poorly soldered to the circuit board due to the fact that the surfaces of the leads on the flatpack IC are usually made of copper or 42 alloy (Fe - 42% Ni alloy), and they may become oxidized or otherwise fouled so as to result in a solder-repelling state if the IC is left to stand for a prolonged period after fabrication. This problem is particularly serious with the 42 alloy which is inherently low in solderability and is prone to cause unsatisfactory soldering. Therefore, in order to ensure reliable soldering of flatpack IC's, the leads are usually plated with a preliminary solder film.

Preliminary plating of the leads of a flatpack IC is usually performed by dipping the IC into a liquid flux bath followed by a molten solder bath. However, a single flatpack IC has a large number of leads (as many as 100 leads if 25 leads come out from each of the four sides, each side extending about 1–2 cm) at very close intervals, e.g. 0.4–0.8 mm, and a "bridge", i.e. a solder deposit spanning two adjacent leads, will form if the leads are simply dipped into a bath of molten solder. Formation of "bridges" may be prevented by the air knife dipping method in which a flatpack IC emerging from a bath of molten solder is immediately blasted with compressed air so as to blow off excess solder. However, in this method, the solder which is blown off one flatpack by the compressed air may be redeposited on other flatpack IC's in the neighborhood, thereby forming "bridges" on those neighboring IC's or impairing their appearance.

SUMMARY OF THE INVENTION

An object of the present invention is to provide a method of performing plating of an item having fine parts in rows and a support device for supporting such an item during plating.

A more particular object of the present invention is to provide a method of performing preliminary plating of the leads of a flatpack IC in which the formation of bridges of solder between adjacent leads is prevented without the use of air blasts.

Another object of the present invention is to provide a support device in the form of a clip for use in performing such preliminary plating of the leads of a flatpack IC.

The present inventors have found that the principal cause of the formation of solder bridges between adjacent leads of a flatpack IC is that when an IC is removed from a bath of molten solder, a large amount of solder remains deposited on the leads. The present inventors have also found that because of the great surface tension of the molten solder deposited on the leads, the molten solder once deposited in the gap between adjacent leads remains to form a bridge that spans the leads.

The method of the present invention has two characteristic features that are based on the aforementioned findings. First, an item having fine parts in rows, such as a flatpack IC which has been dipped into a bath of molten solder is inclined so that excess molten solder will flow off of the fine parts, e.g., the leads of the IC, thereby reducing the amount of solder that may be deposited on the fine parts. Secondly, a flux is employed which exerts a fluxing action on the fine parts of the item being removed from the bath of molten solder, thereby reducing the surface tension of the solder and increasing the chance of the solder film breaking between adjacent fine parts of the item.

Therefore, the present invention provides a method of performing plating of an item having fine parts in which the item is immersed in a bath of molten solder, the item is then removed from the molten solder bath with the fine parts in an inclined state with respect to the surface of the solder bath, and at the same time, a flux is caused to exert a fluxing action on the fine parts to which molten solder is adhered, thereby decreasing the surface tension of the molten solder.

According to a particular mode, the item having fine parts is a flatpack IC, and the present invention provides a method of performing preliminary plating of leads of the flatpack IC without the formation of "bridges" between adjacent leads. In order to attain this object, a flatpack IC that has been dipped into a bath of molten solder is removed therefrom with a row of the leads in an inclined state with respect to the surface of the solder bath, and at the same time, a flux is applied to the leads and allowed to flow down over all the leads so as to exert a fluxing action on the leads as the IC is being removed from the bath so that the surface tension of the molten solder deposited on the leads can be reduced and the formation of bridges can be prevented.

Namely, according to the present invention, when performing the preliminary plating of the leads of an IC, the leads are removed from a bath of molten solder in an inclined state so that as little solder as possible adheres to the leads. Then instead of using a blast of air as in the prior art, a flux is caused to exert a fluxing action on the leads to which the molten solder is adhered. By reducing the surface tension of the molten solder, the flux enables the solder to separate from and flow off the leads under the force of its own weight.

Furthermore, the present invention provides a support device for holding an item having fine parts for use in the method described above. The support device comprises a conveying and supporting member, a clip which can releasably hold an item having fine parts in an inclined attitude and whose upper end is secured to said conveying and supporting member and a flux-retaining member which is secured to the clip and which is disposed above said item so as to cover the upper sides of the item.

The effect of the flux-retaining members is to retain a large amount of flux when the item having fine parts is immersed in the flux bath. When the item is then immersed in a molten solder bath, the flux which was retained by the flux-retaining members floats on the surface of the molten solder bath. When the item is removed from the molten solder bath, the flux is again retained by the flux-retaining members and is able to slowly flow down over the fine parts of the item and exert a fluxing action.

There is no particular restriction on the shape of the flux-retaining member, but the simplest form is that of plates which are arranged so as to form a V-shaped roof which covers the item having fine parts in rows.

In the present invention, an item having fine parts refers to any item having a finely-spaced parts to be plated, the spacing between adjacent fine parts being at most approximately 2 mm and generally at most 0.5 mm. Although the most common example of such an item is a flatpack IC, examples of other items to which the present invention is applicable are mounts for chip carriers and other types of IC leads.

DESCRIPTION OF THE PREFERRED EMBODIMENT

One embodiment of the present invention will hereunder be described while referring to FIGS. 1 to 5.

Figure 1:
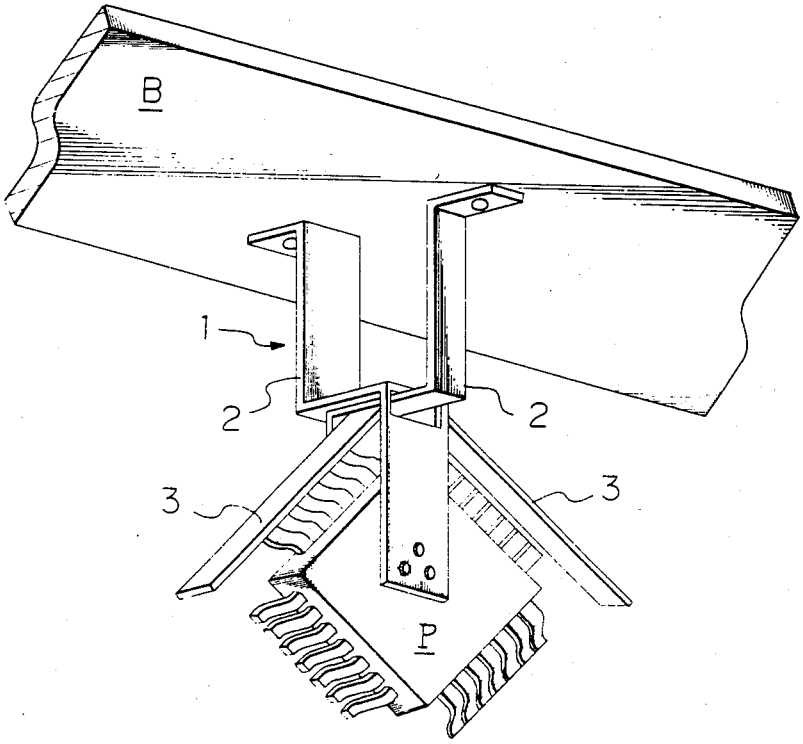
FIG. 1 is a perspective view of the support device of the present invention.

As shown in FIG. 1, a flatpack IC which is generally indicated by reference character P, which has leads coming out from its four sides, and which measures 17 mm×17 mm, for example, is held by a clip 1 in an inclined position such that all four sides are inclined with respect to the horizontal. By the term "inclined position" or "inclined state" is meant a state wherein the four sides of the flatpack IC are inclined, usually at an angle of 15° to 65°, preferably at approximately 45° with respect to the horizontal. However, in the case of a flatpack IC having leads coming out of only 2 opposite sides, it is possible for a row of the leads each on opposite sides to be inclined vertically.

The clip 1 is composed of a pair of crank-shaped leaf springs 2, 2 whose bottom end portions firmly press against the top and bottom surfaces of the flatpack IC so as to support it. The upper ends of the leaf springs 2 are secured by screws or other suitable means to a conveying and supporting member B for transporting the clip 1 and the flatpack IC. The clip 1 is provided with a pair of flux-retaining members 3, 3 that are positioned so as to cover the two upper inclined sides of the IC.

In the case of a flatpack IC having leads coming out of only 2 sides, it is possible for the flux-retaining members 3 to be disposed horizontally rather than diagonally. A horizontal disposition is more suitable when the leads of such an IC are pointing vertically. However, as long as the flux-retaining members 3 are able to retain flux when the flatpack IC is removed from a flux bath and are able to once again retain flux above the leads of the flatpack IC when it is withdrawn from a molten solder bath, there is no restriction on their shape.

Figure 2:
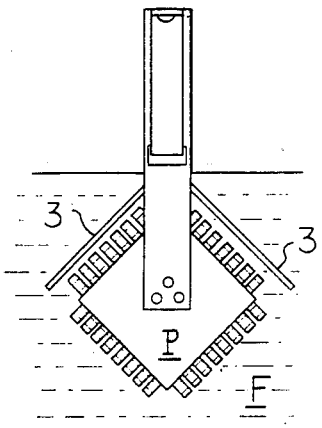
FIGS. 2 to 5 schematically show the sequence of steps followed in implementing preliminary plating of the leads of a flatpack IC by the method of the present invention.

The flatpack IC is dipped into a bath of liquid flux F in this state while being held by the clip 1 as shown in FIG. 2, whereupon an ample amount of the flux is deposited not only on the IC but also on the flux-retaining members 3,3 above the IC. Any suitable flux composition can be used, but for flatpack IC's, a flux comprising hydrogen chloride, ammonium chloride, and polyethylene glycol in an aqueous solution is most common.

Figure 3:
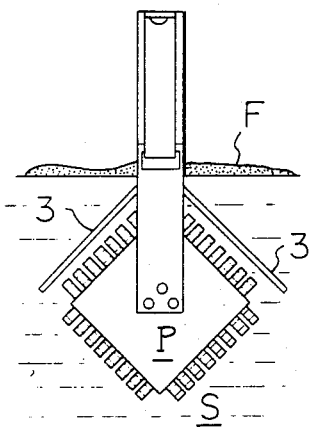
Figure 4:
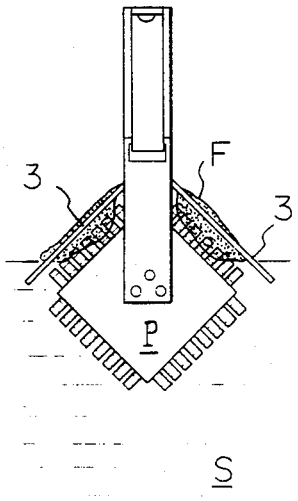
Figure 5:
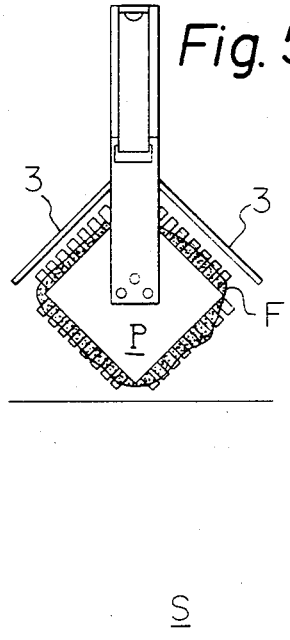

Next, the flatpack IC is dipped into a bath of molten solder S such as 63% Sn - Pb solder alloy while held by the clip 1, as shown in FIG. 3, whereupon the flux separates from the IC and the flux-retaining members 3, 3 and floats on the surface of the molten solder. After the molten solder is deposited on the leads, the clip 1 is recovered from the solder bath, and the flux floating on the surface of the solder is again deposited on the flux-retaining members 3, 3. As shown in FIG. 4, the flux F then moves down the retaining members 3, 3 under its own weight and transfers to the underside of each member 3 due to the surface tension of the flux. The flux then contacts the leads on the sides of the IC facing the retaining members 3, 3, whereby a fluxing action is exerted on the molten solder deposited on these leads. The fluxing action exerted by the flux lowers the surface tension of the molten solder, thereby reducing the amount of solder that will be deposited on the leads, with the result that excess solder flows down an inclined row of the leads. As shown in FIG. 5, the flux deposited from the retaining members 3, 3 on the leads on the two upper sides of the IC also flows down the row of upper leads and then exerts a fluxing action on the leads on the two lower sides of the IC. In this manner, the flux exerts a fluxing action on all of the leads coming out from the flatpack IC, and the surface tension of the molten solder is sufficiently reduced to permit excess solder to flow down and off the four sides of the IC.

In accordance with the present embodiment, the flatpack IC to be subjected to preliminary plating of solder is kept in an inclined position such that all four sides of the IC form angles of approximately 45° with respect to the horizontal. When the IC, after being dipped into a bath of molten solder, is removed therefrom, the molten solder will flow down the four inclined sides of the IC, and at the same time, the flux deposited on the flux-retaining members 3, 3 will exert a fluxing action on all of the leads of the IC by first transferring to the two upper sides of the IC, then flowing down these sides, and finally moving to and flowing down the two lower sides of the IC, thereby ensuring uniform preliminary plating of solder on all the leads extending from the flatpack IC. The flux-retaining members 3, 3 are provided above two adjacent sides of the flatpack IC and serve to retain an adequate amount of flux after the IC is recovered from a bath of the flux. If the IC is subsequently dipped into a bath of molten solder, an ample amount of the flux will float on the surface of the solder bath. If the IC is removed from the solder bath, the flux will be redeposited on the flux-retaining members and exert a fluxing action on all of the leads coming out from the IC in the aforementioned manner.

In the embodiment shown above, the flux-retaining members 3, 3 are in the form of plates, but alternative shapes may also be employed so long as they have the ability to retain a large amount of flux and permit the flux to exert a gradual fluxing action on the leads of a flatpack IC as it is removed from a bath of molten solder.

According to an experiment conducted by the present inventors, a more uniform plating of a preliminary solder coat was achieved by forming the flux-retaining members 3, 3 of a material that is not easily wetted by solder. Most suitable examples of such a material are titanium and zirconium, but stainless steel and plain steels may also be used if their surfaces are covered with a polytetrafluoroethylene coat.

As a method of applying flux to an item having fine parts after immersing it into a molten solder bath, it is possible to spray flux onto the item or to continually cause flux to float upon the surface of the molten solder bath so that when the item is removed from the bath, the flux will be automatically applied to the item. Preferably, however, the previously described method is used in which the item is dipped into a flux bath prior to immersion into a molten solder bath, and a flux-retaining member is disposed above the item.

Although explanation has been made with respect to a flatpack integrated circuit, which is the most common example of an item with fine parts to be plated, the present invention is not to be construed as being applicable only to the plating of flatpack IC's. Similarly, although the present invention has been described with respect to preferred embodiments, various modifications may be employed without departing from the concept of the invention defined in the appended claims

What is claimed is:

1. A support device for use in the preliminary plating of an item having fine parts to be plated, comprising:

a conveying and supporting member;

a clip which can releasably hold said item and whose upper end is secured to said conveying and supporting member; and a flux-retaining member which is secured to said clip and which is disposed above said item so as to form a V-shaped or horizontal roof which covers the upper portion thereof.

2. A support device as claimed in claim 1, wherein:

said item having fine parts is a flatpack IC;

said clip comprises two crank-shaped leaf springs which intersect one another in their midportion, the upper ends of said leaf springs being secured to said conveying and supporting member and the lower ends of said leaf springs confronting one another so as to be able to firmly press against the opposite surfaces of a flatpack IC; and said flux-retaining member comprises two plates which are secured to said clip so as to form a V-shaped roof covering a flatpack IC held by said clip.

3. A support device as claimed in claim 2, wherein the flux-retaining members are in the form of plates made of a material selected from titanium and zirconium.

4. A support device as claimed in claim 2, wherein the flux-retaining members are in the form of plates made of a material selected from stainless steel and plain steel coated by a polytetrafluoroethylene.

* * * * *